US011353286B1

(12) United States Patent
Moultrie et al.

(10) Patent No.: US 11,353,286 B1
(45) Date of Patent: Jun. 7, 2022

(54) HOLSTER ATTACHMENT

(71) Applicant: SHTF GEAR LLC, Logan, UT (US)

(72) Inventors: Clay Thomas Moultrie, Bountiful, UT (US); Sean Sullivan, Logan, UT (US); Jason Eck, Hyrum, UT (US)

(73) Assignee: SHTF GEAR LLC, Logan, UT (US)

( * ) Notice: Subject to any disclaimer, the term of this patent is extended or adjusted under 35 U.S.C. 154(b) by 0 days.

(21) Appl. No.: 17/101,276

(22) Filed: Nov. 23, 2020

(51) Int. Cl.
*F41C 33/04* (2006.01)

(52) U.S. Cl.
CPC ..... *F41C 33/048* (2013.01)

(58) Field of Classification Search
CPC .... F41C 33/04; F41C 33/048; F41C 33/0209; F41C 33/041
See application file for complete search history.

(56) References Cited

U.S. PATENT DOCUMENTS

2014/0027485 A1* 1/2014 Van Heusen ..... F41C 33/0209 224/587
2016/0370143 A1* 12/2016 Laemmlen ..... F41C 33/048
2020/0116455 A1* 4/2020 Haggart ..... F42B 39/02

OTHER PUBLICATIONS

AIWB Holster Gel Wedge Hack, 8541 Tactical, Mar. 4, 2018, https://www.youtube.com/watch?v=VIPPmw5RUPk (Year: 2018).*
Tier 1 Concealed—NEW Wedge Pack!, Tier 1 Concealed, Sep. 4, 2019, https://www.youtube.com/watch?v=mEMmOL7uAMs (Year: 2019).*
Eudax Skid Pad, Jul. 2017, https://www.amazon.com/EUDAX-Anti-Vibration-Shockproof-multirotor-Quadcopter/dp/B06Y5TSYRC/ref=cm_cr_arp_d_product_top?ie=UTF8 (Year: 2017).*

* cited by examiner

*Primary Examiner* — Corey N Skurdal
(74) *Attorney, Agent, or Firm* — Preston P. Frischknecht; Project CIP

(57) ABSTRACT

A holster attachment comprising a deformable member configured to be attached adjacent to the trigger guard of an inside-the-waistband holster for the purpose of positioning a handgun grip towards a user's body.

20 Claims, 10 Drawing Sheets

HOLSTER ATTACHMENT

BACKGROUND OF THE INVENTION

Various commercially available inside-the-waistband (IWB) holster systems provide functionality for twisting the grip of a holstered handgun towards a wearer's body. Such functionality is needed to counteract forces on IWB systems that tend to make the grip of a holstered handgun stick out from a user's body. These forces are typically generated by a belt and/or waistline positioned against a middle portion of the IWB holster wearer's body. The effect of the handgun grip protruding is exacerbated by a combination of these forces and the contours of the wearer's body at the point of holster carry. For many reasons, a protruding handgun grip is undesirable within a holster system. For example, if one of the wearer's objectives is concealed carry, the protruding handgun grip causes printing or outlining of the firearm that is visible through the clothes to outside observers.

One solution to the problem of IWB holster grip protrusion is a structure known as a claw or wing. The geometry of claws or wings varies. Common structures resemble upside down claws or upright wings, hence the name. Such structures utilize a rigid, angled arm that usually attaches forward of trigger guard, and extends distally therefrom to a terminal point that provides a surface area that pushes against a wearers pants and/or clothing, thereby twisting the holster and handgun grip towards the wearers body. While they are effective, there are also downsides to claws and wings. These include including lack of universal holster compatibility (as an aftermarket solution) as well as increased relative expense and decreased comfort due to the size, shape, and rigidity of the structure. What is needed is a new and simpler solution to the IWB handgun grip protrusion effect that provides for more universal compatibility, less expense, and enhanced comfort.

SUMMARY OF THE INVENTION

In accordance with the above, a new and innovative holster attachment is provided. The problem of achieving a simpler solution to the IWB handgun grip protrusion effect that provides for more universal holster compatibility, less expense, and enhanced comfort is solved. Embodiments of the present invention include a holster attachment comprising a deformable member configured to be attached adjacent to the trigger guard of an inside-the-waistband holster.

These and other aspects of the present invention will become more fully apparent from the following description and appended claims or may be learned by the practice of the invention as set forth hereinafter.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings may not be drawn to scale. The invention will be described and explained with additional specificity and detail through the use of the accompanying drawings in which.

DETAILED DESCRIPTION OF THE ILLUSTRATED EMBODIMENT

The present invention in its various embodiments, some of which are depicted in the figures herein, is a holster attachment.

Figure 1:
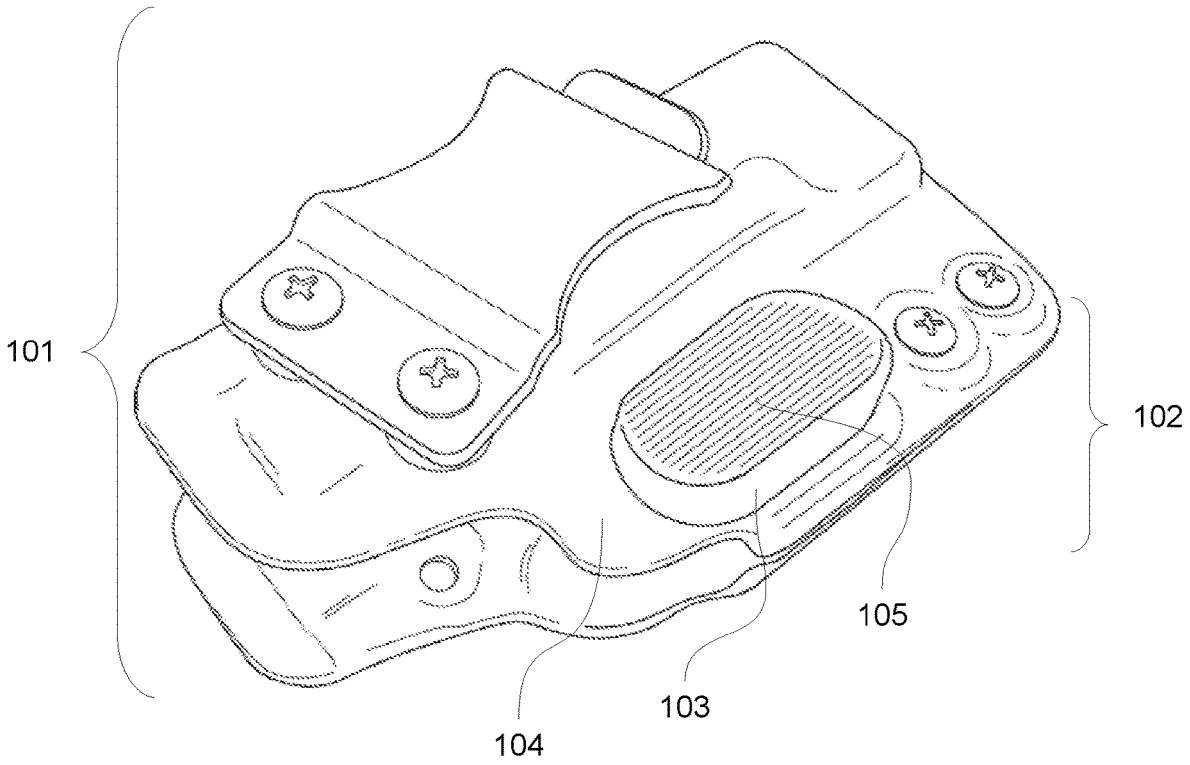
FIG. 1 is a perspective view of a first embodiment of a holster attachment.
Figure 2:
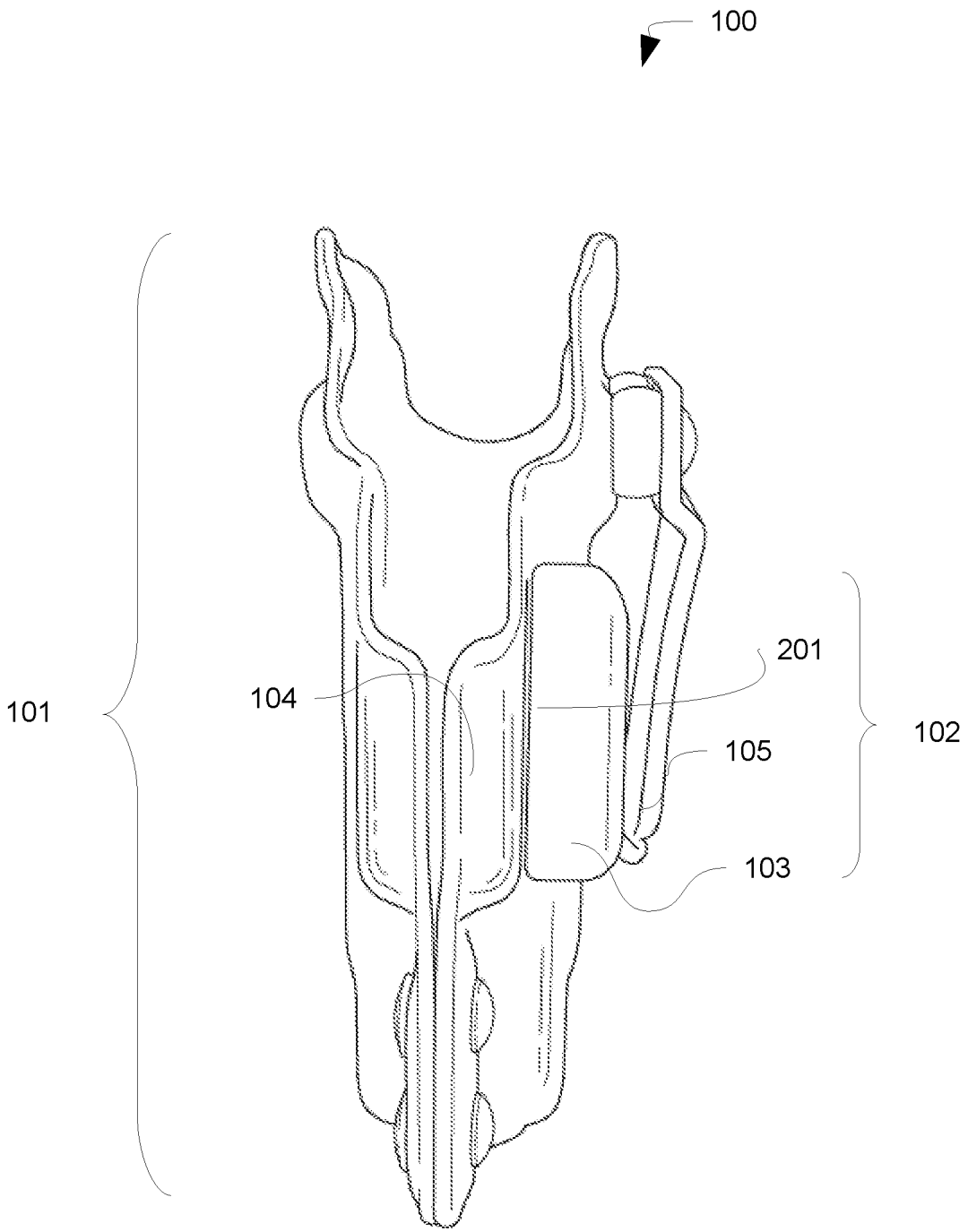
FIG. 2 is a side view of a first embodiment of a holster attachment.
Figure 3:
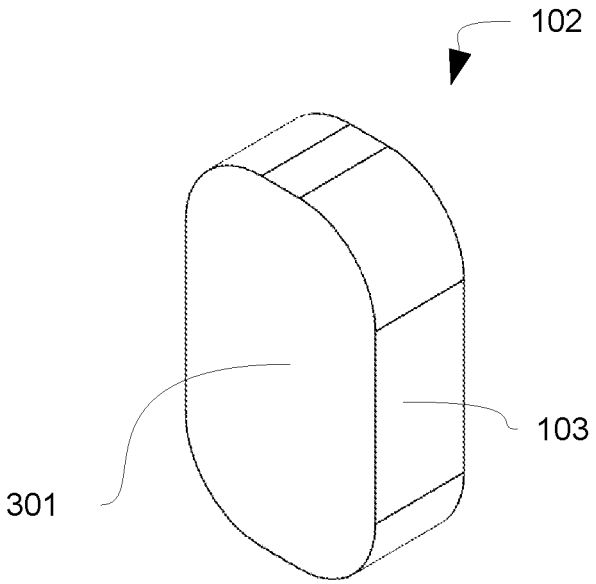
FIG. 3 is an isometric view of a second embodiment of a holster attachment.
Figure 4:
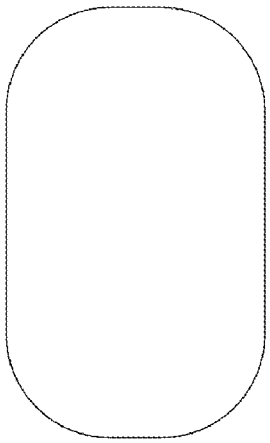
FIG. 4 is a front view of a second embodiment of a holster attachment.
Figure 5:
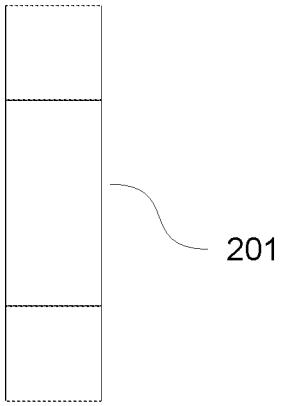
FIG. 5 is a first side view of a second embodiment of a holster attachment.
Figure 6:
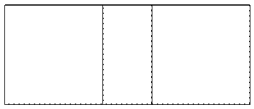
FIG. 6 is a second side view of a second embodiment of a holster attachment.
Figure 7:
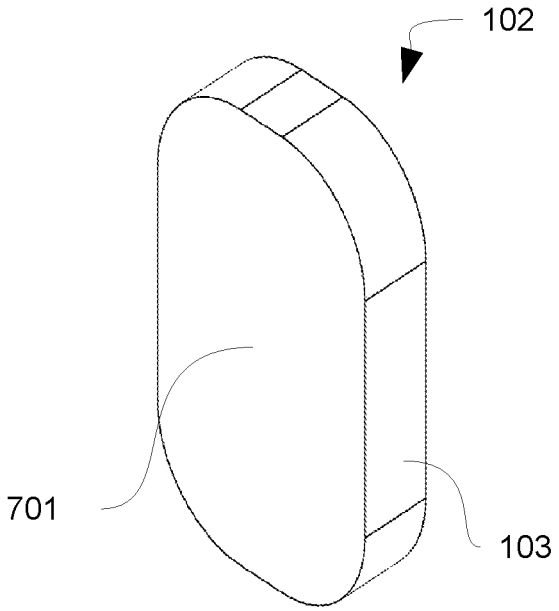
FIG. 7 is an isometric view of a third embodiment of a holster attachment.
Figure 8:
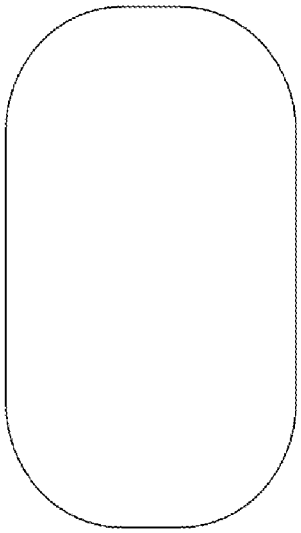
FIG. 8 is a front view of a third embodiment of a holster attachment.
Figure 9:
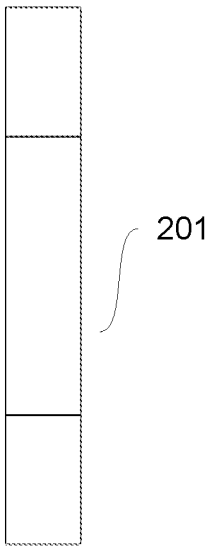
FIG. 9 is a first side view of a third embodiment of a holster attachment.
Figure 10:
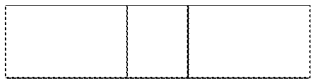
FIG. 10 is a second side view of a third embodiment of a holster attachment.

Referring now to FIGS. 1 through 2, one embodiment of a holster attachment is shown in an inside-the-waistband (IWB) holster 101. In the illustrated embodiment, the holster attachment includes a deformable member 102 having an outside edge, perimeter, and/or circumference 103 generally shaped and/or sized to correspond to the shape of a trigger guard on a handgun and/or the trigger guard portion of an IWB holster. Deformable member 102 is configured to be attached adjacent to the trigger guard 104 of an IWB holster 101. Deformable member 102 has a first side with adhesive 201 for joining the deformable member 102 to the IWB holster 101. In preferred embodiments, first side with adhesive 201 is generally planar. Deformable member 102 may be made of any number of materials that achieve some degree of deformation, including, for example, foam and elastomers, gels, 3D printed and/or printable materials, and the like.

Across embodiments, the deformable member 102 is operable to position a handgun grip towards a user's body when the deformable member 102 is joined to and in operation with the IWB holster 101, including by providing an outermost deformable member contact that is generally located in a belt path of the IWB holster. Some embodiments of the holster attachment may include versions where the deformable member 102 is an after-market accessory for an IWB holster. Other embodiments of the holster attachment may include versions where the deformable member 102 is part of and sold together with an IWB holster 101.

Figure 11:
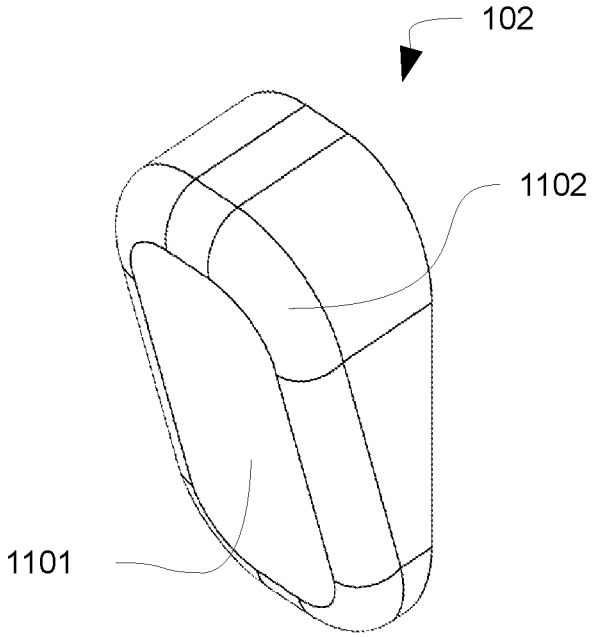
FIG. 11 is an isometric view of a fourth embodiment of a holster attachment.
Figure 12:
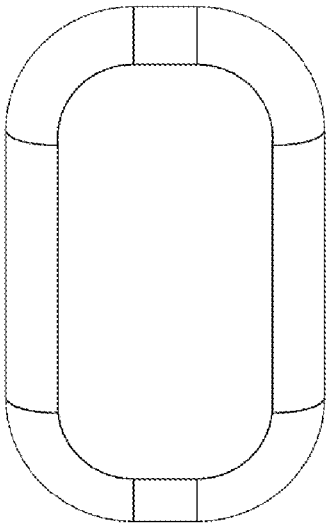
FIG. 12 is a front view of a fourth embodiment of a holster attachment.
Figure 13:
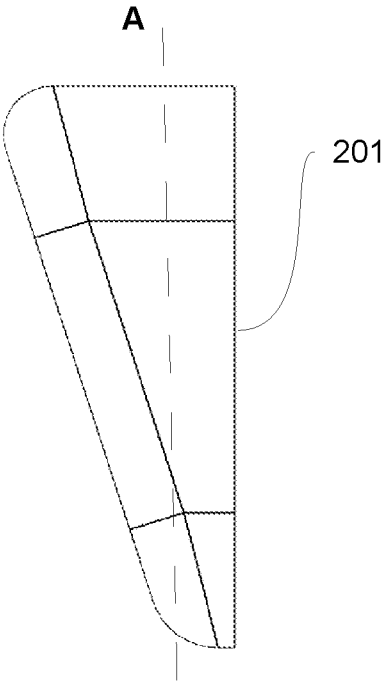
FIG. 13 is a first side view of a fourth embodiment of a holster attachment.
Figure 14:
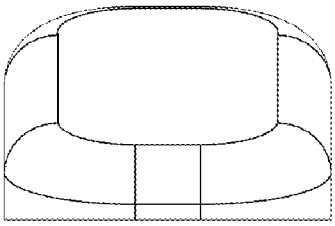
FIG. 14 is a second side view of a fourth embodiment of a holster attachment.
Figure 15:
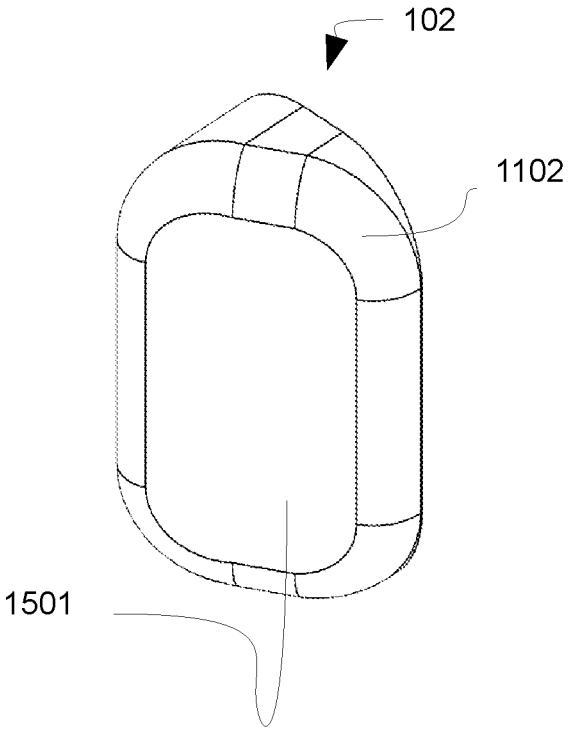
FIG. 15 is an isometric view of a fifth embodiment of a holster attachment.
Figure 16:
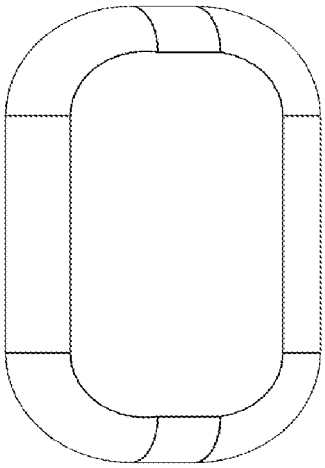
FIG. 16 is a front view of a fifth embodiment of a holster attachment.
Figure 17:
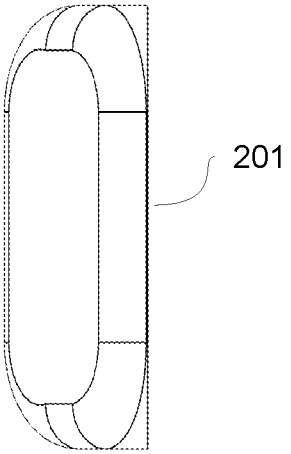
FIG. 17 is a first side view of a fifth embodiment of a holster attachment.
Figure 18:
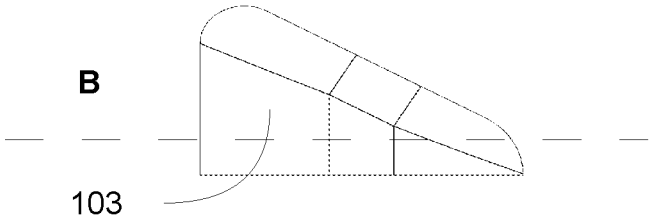
FIG. 18 is a second side view of a fifth embodiment of a holster attachment.
Figure 19:
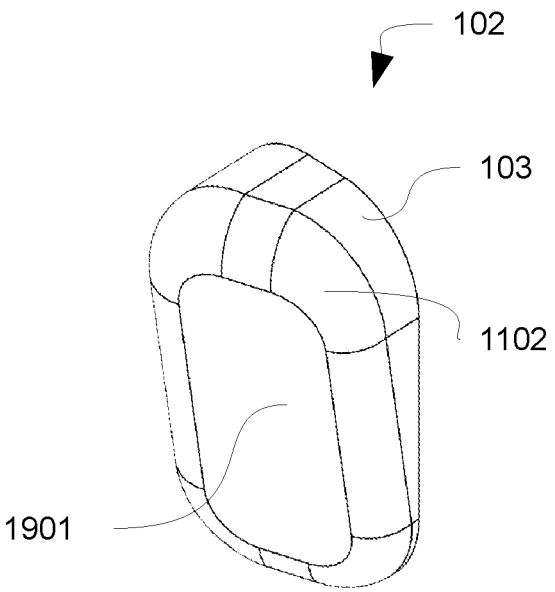
FIG. 19 is an isometric view of a sixth embodiment of a holster attachment.
Figure 20:
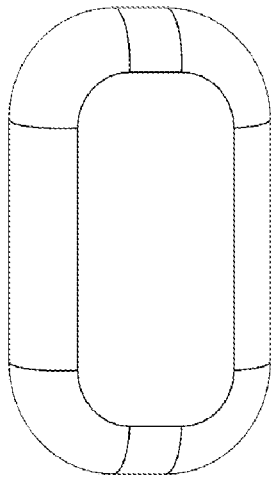
FIG. 20 is a front view of a sixth embodiment of a holster attachment.
Figure 21:
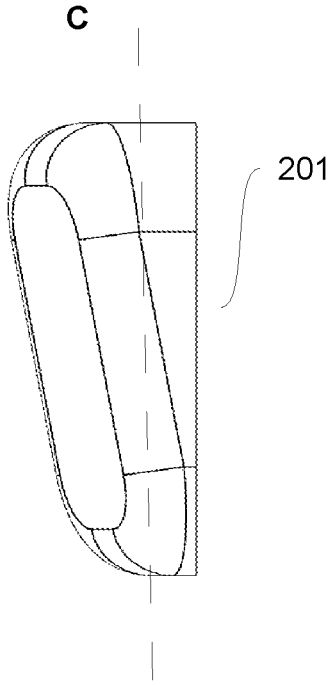
FIG. 21 is a first side view of a sixth embodiment of a holster attachment.
Figure 22:
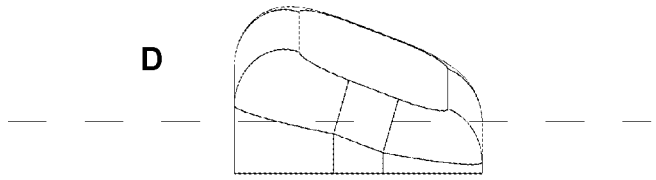
FIG. 22 is a second side view of a sixth embodiment of a holster attachment.
Figure 23:
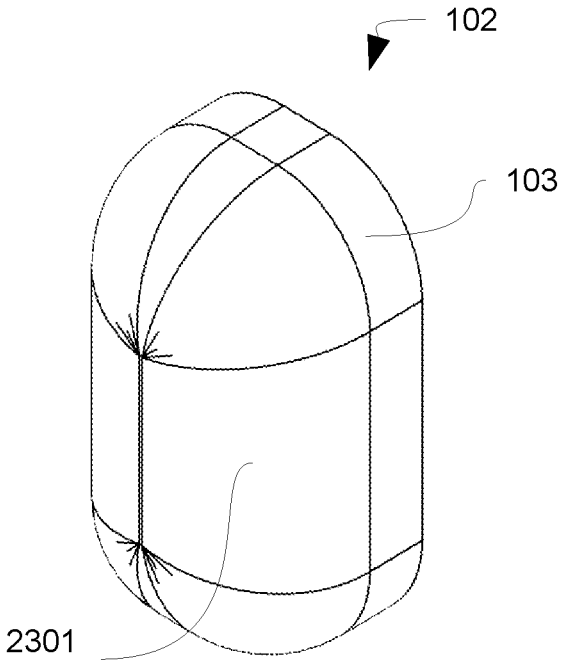
FIG. 23 is an isometric view of a seventh embodiment of a holster attachment.
Figure 24:
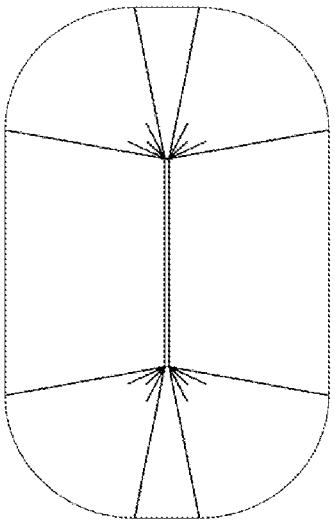
FIG. 24 is a front view of a seventh embodiment of a holster attachment.
Figure 25:
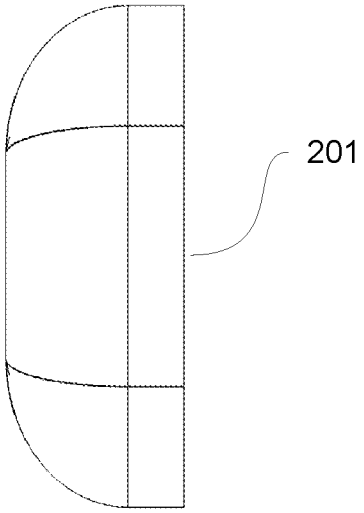
FIG. 25 is a first side view of a seventh embodiment of a holster attachment.
Figure 26:
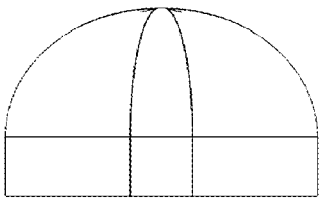
FIG. 26 is a second side view of a seventh embodiment of a holster attachment.
Figure 27:
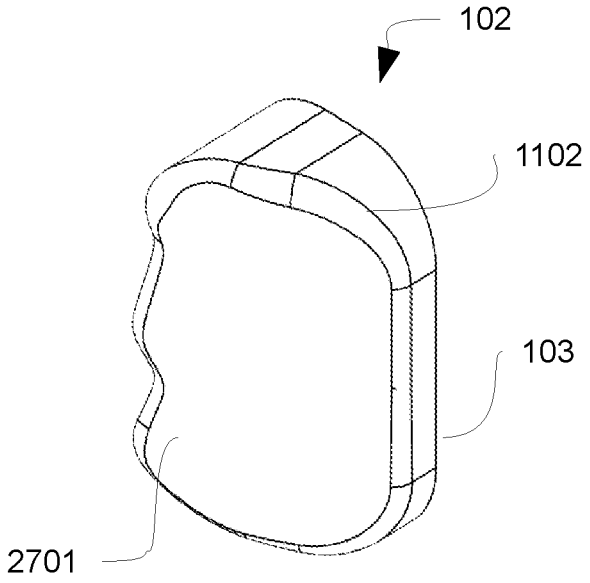
FIG. 27 is an isometric view of an eighth embodiment of a holster attachment.
Figure 28:
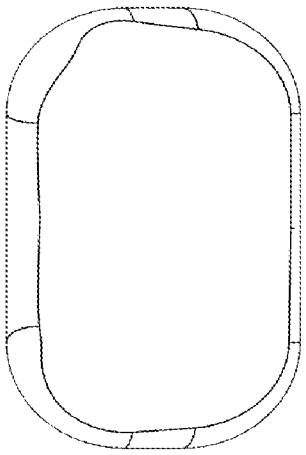
FIG. 28 is a front view of an eighth embodiment of a holster attachment.
Figure 29:
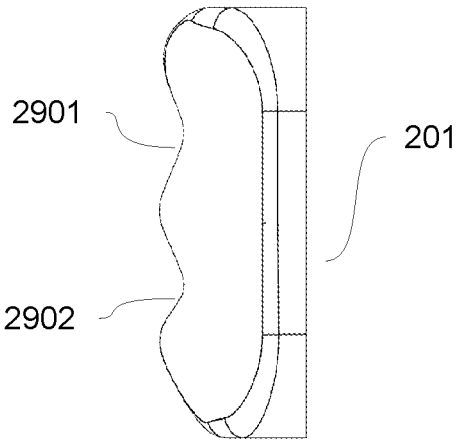
FIG. 29 is a first side view of an eighth embodiment of a holster attachment.
Figure 30:
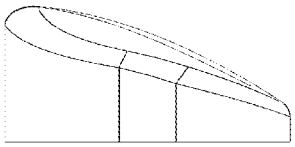
FIG. 30 is a second side view of an eighth embodiment of a holster attachment.
Figure 31:
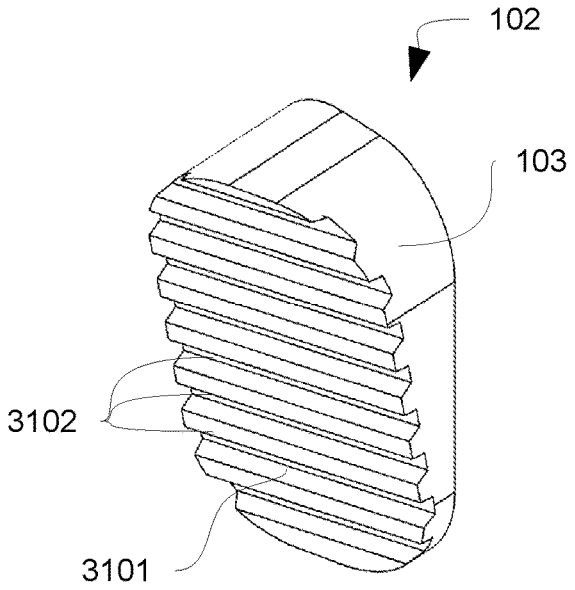
FIG. 31 is an isometric view of a ninth embodiment of a holster attachment.
Figure 32:
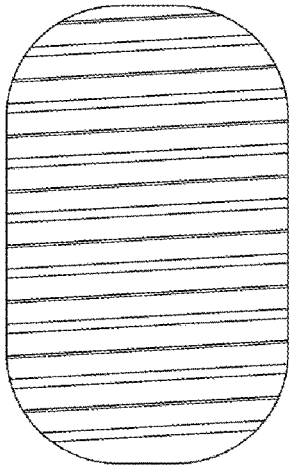
FIG. 32 is a front view of a ninth embodiment of a holster attachment.
Figure 33:
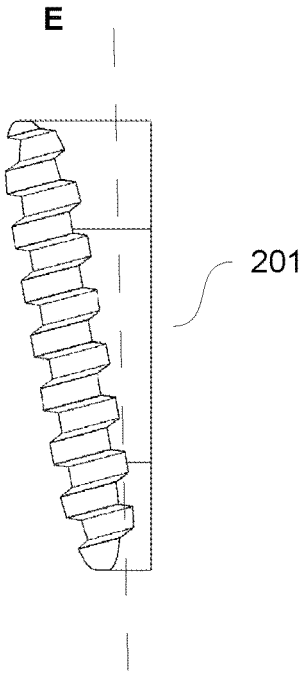
FIG. 33 is a first side view of a ninth embodiment of a holster attachment.
Figure 34:
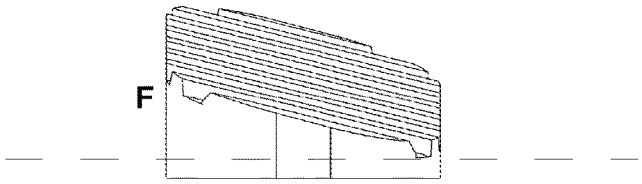
FIG. 34 is a second side view of a ninth embodiment of a holster attachment.

In various embodiments, deformable member 102 may include one or more additional sides, shapes, and/or features to achieve various functions. For example, deformable member 102 may include a second or facing side 105 that is substantially planar. See also FIGS. 3-6 (301), FIGS. 7-10 (701), FIGS. 11-14 (1101), FIGS. 15-18 (1501), and FIGS. 19 through 22 (1901). Referring to FIG. 11, the substantially planar face of deformable member 102 may be bounded by a curved, transitioning edge 1102 adjacent to the outside edge, perimeter, and/or circumference.

Second, deformable member 102 may include a facing side that is generally angled. Referring to the embodiment of FIGS. 11 through 14, the face 1101 is generally angled with respect to a vertical and/or longitudinal axis A. Referring to the embodiment of FIGS. 15 through 18, the face 1501 is generally angled with respect to a horizontal and/or latitudinal axis B. Referring to the embodiment of FIGS. 19 through 22, the face 1901 incorporates a compound angle such that it is angled with respect to both a vertical and/or longitudinal axis C and a horizontal and/or latitudinal axis D. See also FIGS. 31-34 (3101).

Deformable member 102 may also have a curved facing side. For example, referring to FIGS. 23 through 26, the face 2301 may be spheroid, ellipsoid or paraboloid. Alternatively, referring now to FIGS. 27 through 30, deformable member 102 may have an undulating face 2701 with grooves 2901, 2902.

Referring to FIGS. 31 through 34, deformable member 102 may have a face 3101 with a plurality of channels 3102. Any number of permutations of the above sides, shapes, and/or features may be included, as well as many other additional sides, shapes, and/or features, without departing from the purpose or scope of the invention. Those enumerated herein are for illustrative purposes only. Deformable member 102 may be characterized as generally orthotope, which includes, for example, traditional, rounded and/or semi-: rectangle, hyperrectangle, cuboid, and elliptical shapes, in addition others set forth herein.

Expressed as a method of use of a holster attachment as described above, steps may include providing a deformable member configured to attach to an IWB holster and attaching the deformable member to the IWB at a location such that the deformable member is substantially located in a belt path of the IWB holster. The deformable member may have a perimeter and/or circumference generally shaped to correspond to the shape of a trigger guard on a handgun and be configured to attach generally only over a trigger guard portion of the IWB holster.

Thus configured, embodiments of the present invention include a holster attachment comprising a deformable member configured to be attached adjacent to the trigger guard of an IWB holster. The problem of achieving a simpler solution to the IWB handgun grip protrusion effect that also provides for more universal holster compatibility, less expense, and enhanced comfort is solved.

The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A holster attachment comprising:

a generally orthotope deformable member configured to attach over a trigger guard portion of an IWB holster without extending substantially onto other portions of the IWB holster, the generally orthotope deformable member further having a face with a plurality of channels.

2. The holster attachment of claim 1, the generally orthotope deformable member further having a side with adhesive for joining the generally orthotope deformable member to the IWB holster.

3. The holster attachment of claim 1, further operable configured to position a handgun grip towards a user's body when the generally orthotope deformable member is joined to and in operation with the IWB holster by providing a deformable member contact that is substantially located in a belt path of the IWB holster.

4. The holster attachment of claim 1, wherein the holster attachment is an after-market accessory for the IWB holster.

5. The holster attachment of claim 1, the generally orthotope deformable member further having a perimeter generally shaped and sized to correspond to the shape and size of a perimeter of the trigger guard on a handgun portion.

6. The holster attachment of claim 1, the generally orthotope deformable member further having a circumference generally shaped and sized to correspond to the shape and size of a circumference of the trigger guard on a handgun portion.

7. A holster attachment comprising:

a deformable member having a face with a plurality of channels, the deformable member configured to attach over a trigger guard portion of an IWB holster without extending substantially onto other portions of the IWB holster and having an outside edge generally shaped and sized to correspond to the shape and size of the trigger guard portion, and further having a side with adhesive for joining the deformable member to the trigger guard portion, the holster attachment configured to position a handgun grip towards a user's body when the deformable member is joined to and in operation with the IWB holster by providing an outermost deformable member contact that is substantially located in a belt path of the IWB holster.

8. An IWB holster with a holster attachment comprising:

a deformable member configured to attach over a trigger guard portion of the IWB holster without extending substantially onto other portions of the IWB holster, the deformable member further operable to position a handgun grip towards a user's body when the deformable member is in operation with the IWB holster by providing an outermost deformable member contact that is generally located in a belt path of the IWB holster.

9. The IWB holster with a holster attachment of claim 8, the deformable member further having a perimeter generally shaped to correspond to the shape of the trigger guard portion.

10. The IWB holster with a holster attachment of claim 8, the deformable member further having a circumference generally shaped to correspond to the shape of the trigger guard portion.

11. The IWB holster with a holster attachment of claim 8, the deformable member further having a generally angled face.

12. The IWB holster with a holster attachment of claim 8, the deformable member further having a face with a plurality of channels.

13. The IWB holster with a holster attachment of claim 8, the deformable member further having a face with a compound angle.

14. The IWB holster with a holster attachment of claim 8, the deformable member further having a curved face.

15. The IWB holster with a holster attachment of claim 8, wherein the deformable member is from one of the group of foam and elastomer.

16. A method of use for a holster attachment comprising the steps of: providing a deformable member configured to attach to an IWB holster; and attaching the deformable member to the IWB holster at a location such that the deformable member is substantially located in a belt path of the IWB holster.

17. The method of claim 16, the deformable member configured to attach over a trigger guard portion of the IWB holster without extending substantially onto other portions of the IWB holster.

18. The method of claim 16, the deformable member having a perimeter generally shaped to correspond to the shape of a trigger guard portion on the IWB holster.

19. The method of claim 16, the deformable member having a circumference generally shaped to correspond to the shape of a trigger guard portion on the IWB holster.

20. A method for optimizing the fit of an IWB holster with a deformable member comprising the steps of:

providing an IWB holster;

providing a generally orthotope deformable member configured to attach over a trigger guard portion of the IWB holster without extending substantially onto other portions of the IWB holster; and attaching the generally orthotope deformable member over a trigger guard portion of the IWB holster such that the generally orthotope deformable member does not extend substantially onto other portions of the IWB holster.

* * * * *